US008316740B2

(12) United States Patent
Idir

(10) Patent No.: US 8,316,740 B2
(45) Date of Patent: Nov. 27, 2012

(54) STRAP PIPE WRENCH FOR DRIVING AN OBJECT HAVING A GENERALLY CYLINDRICAL SHAPE

(75) Inventor: Hadi Idir, Sevran (FR)

(73) Assignee: Stanley Works (Europe) GmbH, Dubendorf (CH)

( * ) Notice: Subject to any disclaimer, the term of this patent is extended or adjusted under 35 U.S.C. 154(b) by 271 days.

(21) Appl. No.: 12/452,008

(22) PCT Filed: May 30, 2008

(86) PCT No.: PCT/FR2008/050961

§ 371 (c)(1),
(2), (4) Date: Feb. 24, 2010

(87) PCT Pub. No.: WO2009/004201

PCT Pub. Date: Jan. 8, 2009

(65) Prior Publication Data

US 2010/0192731 A1 Aug. 5, 2010

(30) Foreign Application Priority Data

Jun. 12, 2007 (FR) ..... 07 55688

(51) Int. Cl.
*B25B 13/52* (2006.01)

(52) U.S. Cl. ..... 81/64; 81/3.43

(58) Field of Classification Search ..... 81/64, 65, 81/3.4, 3.43

See application file for complete search history.

(56) References Cited

U.S. PATENT DOCUMENTS

| | | | | |
|---|---|---|---|---|
| 3,200,676 | A * | 8/1965 | Pagel | 81/64 |
| 4,150,591 | A * | 4/1979 | Ackeret | 81/65 |
| 4,532,833 | A * | 8/1985 | Downs | 81/64 |
| 5,692,789 | A * | 12/1997 | Woodsum | 81/3.43 |
| 6,196,090 | B1 | 3/2001 | Dumont | |
| 7,155,999 | B1 | 1/2007 | Helfet | |

FOREIGN PATENT DOCUMENTS

| | | |
|---|---|---|
| DE | 2 122 900 | 11/1971 |
| FR | 2 779 373 | 10/1998 |

OTHER PUBLICATIONS

International Search Report issued Nov. 26, 2008 in International (PCT) Application No. PCT/FR2008/050961.

* cited by examiner

*Primary Examiner* — Hadi Shakeri
(74) *Attorney, Agent, or Firm* — Wenderoth, Lind & Ponack, L.L.P.

(57) ABSTRACT

A strap pipe wrench for driving an object having a generally cylindrical shape includes a handle which extends along a longitudinal axis, a connecting member which is movable relative to the handle in a direction parallel to the longitudinal axis, and a strap formed in a loop and having two opposing end portions which cooperate with two zones integral with the handle when the strap surrounds the object tightly, the two opposing end portions of the strap being attached to the connecting member, a displacement device for displacing said connecting member, and enabling the size of the loop of the strap to be adjusted and the strap to be tensioned when it surrounds the object tightly, and a shoe disposed between the two zones for abutment on the object, the shoe having an abutment face of generally arcuate shape.

18 Claims, 11 Drawing Sheets

STRAP PIPE WRENCH FOR DRIVING AN OBJECT HAVING A GENERALLY CYLINDRICAL SHAPE

BACKGROUND OF THE INVENTION (1) Field of the Invention

The present invention relates to a strap pipe wrench for driving an object having a generally cylindrical shape, of the type comprising:

- a part forming a handle which extends according to a longitudinal axis;
- a strap, especially a metal strap, in loop form, the two opposing end portions of which cooperate with two zones integral with the handle when the strap surrounds said object tightly;
- a connecting member which is movable relative to the part forming a handle according to the longitudinal axis thereof, the two opposing end portions of the strap having ends that are integral with said member;
- means for displacing said connecting member, enabling the size of the loop of the strap to be adjusted and the strap to be tensioned when it surrounds said object tightly; and
- the part forming a handle being equipped, between said two zones, with a shoe for abutment on said object, the abutment shoe not being connected to the strap and having an abutment face of generally cylindrical shape with generatrices that are perpendicular to the general plane of the strap.

The invention is applicable in particular to oil filter wrenches for motor vehicles, and reference will be made to this application in the following.

(2) Description of Related Art

Examples of such strap pipe wrenches are described in document FR-A-1.570.027 and in documents FR-A-2.779.372 and FR-A-2.779.373 in the name of the Applicant.

In those known strap pipe wrenches, a screw/nut system allows the strap to be connected to the handle. Because the nut is connected to the strap, a rotary movement of the screw allows the user to adjust the working length of the strap manually by means of a wheel. The phases of adjusting the strap are lengthy and repetitive.

BRIEF SUMMARY OF THE INVENTION

An object of the invention is to facilitate the adjustment of the strap in a particularly ergonomic manner.

To that end, the invention relates to a strap pipe wrench of the type mentioned above, characterised in that said connecting member is movable between at least one first position corresponding to the position of the strap, in the loose state, surrounding said object with clearance, and a second position corresponding to the position of the strap, in the tensioned state, surrounding, tightly and firmly, said object in abutment on the abutment face of the shoe, and the displacement means comprising:

- elements for locking said connecting member, said locking elements being suitable, in the active position, for keeping said member fixed relative to the part forming a handle when said member is in the first position;
- a resilient biasing element, especially a compression or draw spring, which urges said member towards the second position; and
- a control member suitable for deactivating said locking elements.

According to other features, the strap pipe wrench according to the invention can have one or more of the following features, taken in isolation or in all technically possible combinations:

- the control member comprises a rod which is integral with the part forming a handle and extends inside that part according to its longitudinal axis, said rod being suitable for engaging with the locking elements at least when the connecting member is in the first position;
- the locking elements comprise at least one piston, preferably two pistons, carried by the connecting member, the or each piston being in abutment in a groove formed on the rod when the connecting member is in its first position;
- the or each piston is urged resiliently so that it tends to engage in the groove of the rod;
- the rod comprises at least one rack in which there engages at least one retaining finger carried by the connecting member when the latter is in its second position;
- the rod comprises four faces having two racks in the form of saw-teeth and two flat areas, the racks and the flat areas being arranged opposite one another in pairs, and the connecting member comprises two retaining fingers each engaging with a rack;
- the rod is mounted for rotation relative to the connecting member and to the handle about an axis of rotation that is substantially coincident with the longitudinal axis of the handle, between a locking position corresponding to the first position of the connecting member, in which the or each piston enters the groove, and a release position, arranged 90° from the locking position of the rod, corresponding to the second position of the connecting member, in which the or each piston is in abutment on a flat area of the rod;
- the control member also comprises an activation lever which enables said rod to be rotated from its locking position to its release position and vice versa;
- the rod is mounted to be movable in translation towards the proximal end of the handle, against a resilient biasing element, so as to tend to displace the connecting member integrally in order to increase the tension of the strap surrounding, tightly and firmly, said object in abutment on the abutment face of the shoe;
- the activation lever allows said rod to pass from its second position to a third position corresponding to the displacement of said rod in translation;
- the abutment shoe is adapted to produce a ratchet effect for unidirectional driving of said object, driving resulting from a toggle lever effect;
- the abutment shoe is mounted to tilt relative to the handle about a geometric axis associated with the handle and perpendicular to the general plane of the strap, the axis being arranged so that, the shoe and the strap both being applied with clamping to said object, action on the handle exerted in a first direction causes driving of the object and, when exerted in the other direction, causes the shoe and the strap to slide on the object;
- said geometric axis is offset laterally relative to the longitudinal axis of the handle, the direction of the offset being said first direction;
- the abutment shoe is mounted to tilt freely and with a limited amplitude about said axis; and
- the abutment shoe has an abutment face whose coefficient of friction is markedly higher in one direction of rotation of the wrench than in the other direction, for example by virtue of sloping saw-teeth provided on the abutment face.

BRIEF DESCRIPTION OF THE DRAWINGS

The invention and the advantages thereof will be better understood upon reading the following description, which is given solely by way of example and with reference to the accompanying drawings, in which.

DETAILED DESCRIPTION OF THE INVENTION

Figure 1:
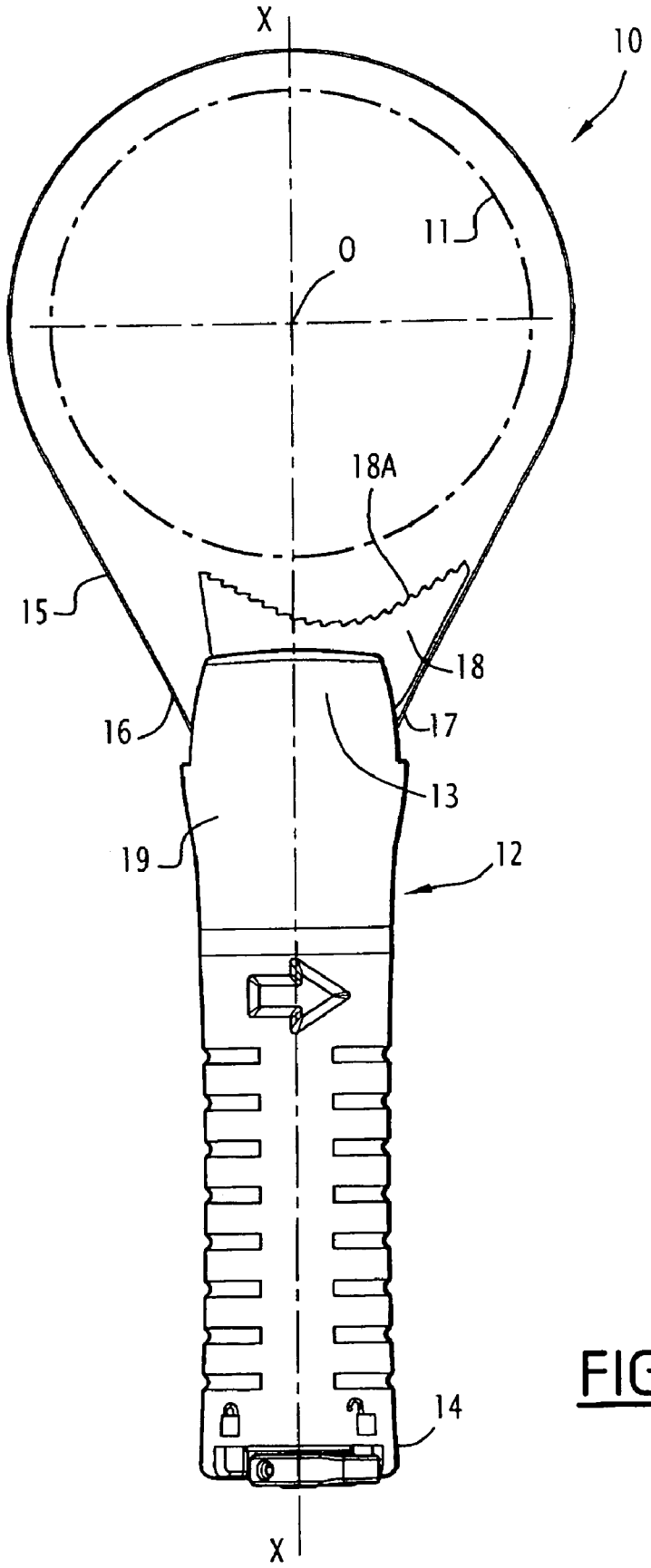
FIG. 1 is an outside front view of the strap pipe wrench according to the invention, with the strap positioned loosely around an oil filter that is to be unscrewed.

The strap pipe wrench 10 shown in FIGS. 1 to 12 is intended principally for unscrewing, and secondarily, by turning the wrench round, for screwing in, objects 11 having a generally cylindrical shape, especially oil filters, the diameters of which can vary within a wide range, for example, in the embodiment shown, from 64 to 106 mm.

In order to describe the wrench 10 more easily, it will be assumed to be oriented as shown in the drawings, extending according to a longitudinal axis X-X with the filter 11, of axis O, situated above the handle of the wrench.

In FIG. 1, the strap pipe wrench 10 comprises a handle 12 having a distal portion 13 that forms a cap, the sides of which are parallel to the plane of the drawing, and a proximal portion 14.

A band 15, especially a band made of metal and forming a strap in the form of a loop, has two end portions 16 and 17 which are connected to the handle 12. A shoe for abutment on the filter 11, having the reference numeral 18, is articulated in the distal portion 13 forming a cap and is arranged freely between the two end portions of the strap 15.

The shoe 18 is wholly independent of the strap and is as described in documents FR-A-2.779.372 and FR-A-2.779.373. In particular, it is mounted to tilt freely and with limited amplitude about an axis associated with the handle 12 and perpendicular to the general plane of the strap 15. It has an upper abutment face 18A of generally cylindrical shape with generatrices that are perpendicular to the general plane of the strap 15, which is the plane of the drawing. The guiding line of the cylinder can be in a very wide V-shape, as shown, or alternatively, by way of variation, it can be circular, for example having a radius corresponding to the smallest radius of the filters to be handled. The face 18A additionally has the form of saw-teeth sloping to the right in FIG. 1, for a reason which will become apparent hereinbelow.

A seat 19 connects the cap 13 to the main portion of the handle 12.

Figure 2:
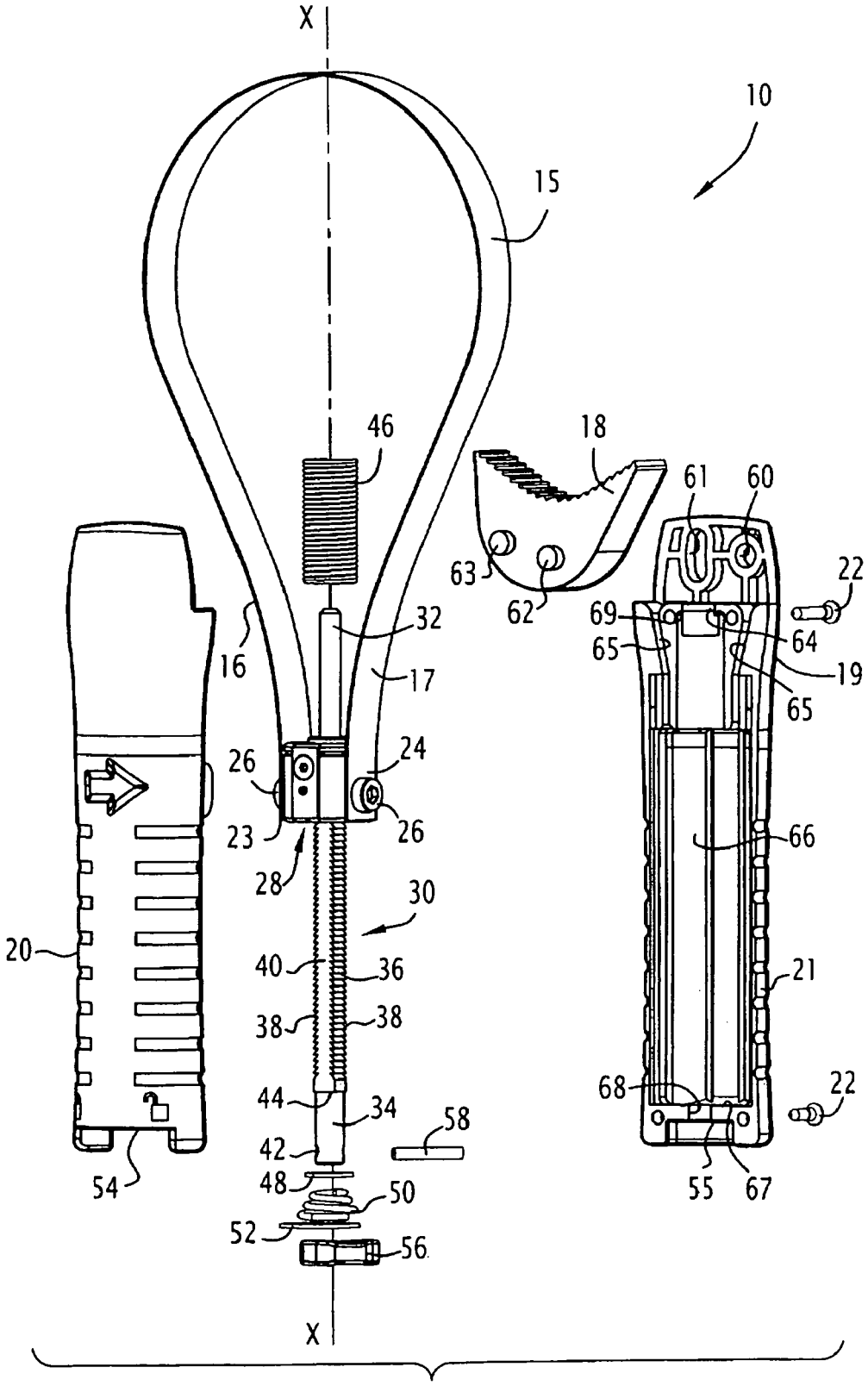
FIG. 2 is an exploded perspective view of the strap pipe wrench according to FIG. 1.

As is shown in FIG. 2, the handle 12 is composed of two molded half-shells 20 and 21 which are fitted together, for example, by screws 22 according to a vertical joining plane situated in the mid-plane of the strap.

The strap 15 has ends 23 and 24 on the respective end portions 16 and 17. Screws 26 connect the ends 23 and 24 of the strap 15 rigidly to a connecting member 28. A rod 30 having an upper end 32, a lower end 34 and an intermediate portion 36 passes through the connecting member 28. The upper end 32 is smooth and of reduced diameter; the lower end 34 is also smooth and has a diameter greater than that of the end 32.

The intermediate portion 36 is of generally cylindrical shape having four faces, which form two diametrically opposite racks 38 and two flat areas 40 which are also diametrically opposite.

A through-bore 42 is arranged transversely to the rod 30 at the lower end 34, and a shoulder 44 connects the intermediate portion 36 to the lower portion 34.

A helical compression spring 46 is arranged coaxially with the upper portion 32 of the rod 30. The ends of the spring 46 are in abutment on the one hand, in its lower portion, on the connecting member 28 and on the other hand, in its upper portion, on inside parts of the seat 19 of the half-shells 20 and 21.

A washer 48 is arranged in the region of the shoulder 44 and serves as an abutment surface for a conical compression spring 50 arranged coaxially with the lower portion 34 of the rod 30.

A washer 52 having a diameter larger than that of the washer 48 is arranged in the bottom of receivers 54 and 55 formed in the region of the proximal portion 14 of the sleeve 12 on each of the half-shells 20 and 21.

An activation lever 56, the function of which will be described more precisely hereinbelow, is arranged in the receivers 54 and 55. A pin 58 arranged inside the transverse bore 42 articulates the lever 56 on the lower end 34 of the rod 30.

Each side of the cap 13 has two concentric blind receivers, namely a circular receiver 60 and an arc-shaped receiver 61.

The shoe 18 is articulated in the cap 13 about a pin 62 whose axis, which is offset relative to the longitudinal axis X-X, bears the same reference numeral. The pin 62 protrudes from each side of the shoe and rotates in the receivers 60 provided in the sides of the cap 13. A pin 63 also protrudes from each side of the shoe, its ends being received in the arc-shaped receivers 61 provided in the sides of the cap 13.

The seat 19 of each shell 20, 21 has on the inside a bearing 64 which is to receive the upper end 32 of the rod 30.

Support slots 65 are arranged in a sloping manner converging towards the proximal end 14 of the handle 12. The two opposite end portions 16 and 17 rest on the outside face of the two support slots 65 when the strap surrounds the filter 11 tightly. The slots 65 open on the one hand into the cap 13 and on the other hand into a cavity 66 formed longitudinally inside each of the half-shells 20 and 21.

The cavities 66 extend, on the inside, over approximately three-quarters of the main portion of the handle 12 so as to form, once the half-shells 20 and 21 have been fitted together, a receiver for receiving the connecting member 28 to which the ends of the strap 15 are fixed. Each receiver 66 is delimited in the region of the proximal portion 14 of each half-shell 20, 21 by a wall 67. The enlarged lower turn of the conical spring 50 rests on the wall 67. A bore 68 passes through the wall 67 and serves as a bearing for the lower end 34 of the rod 30.

Figure 3:
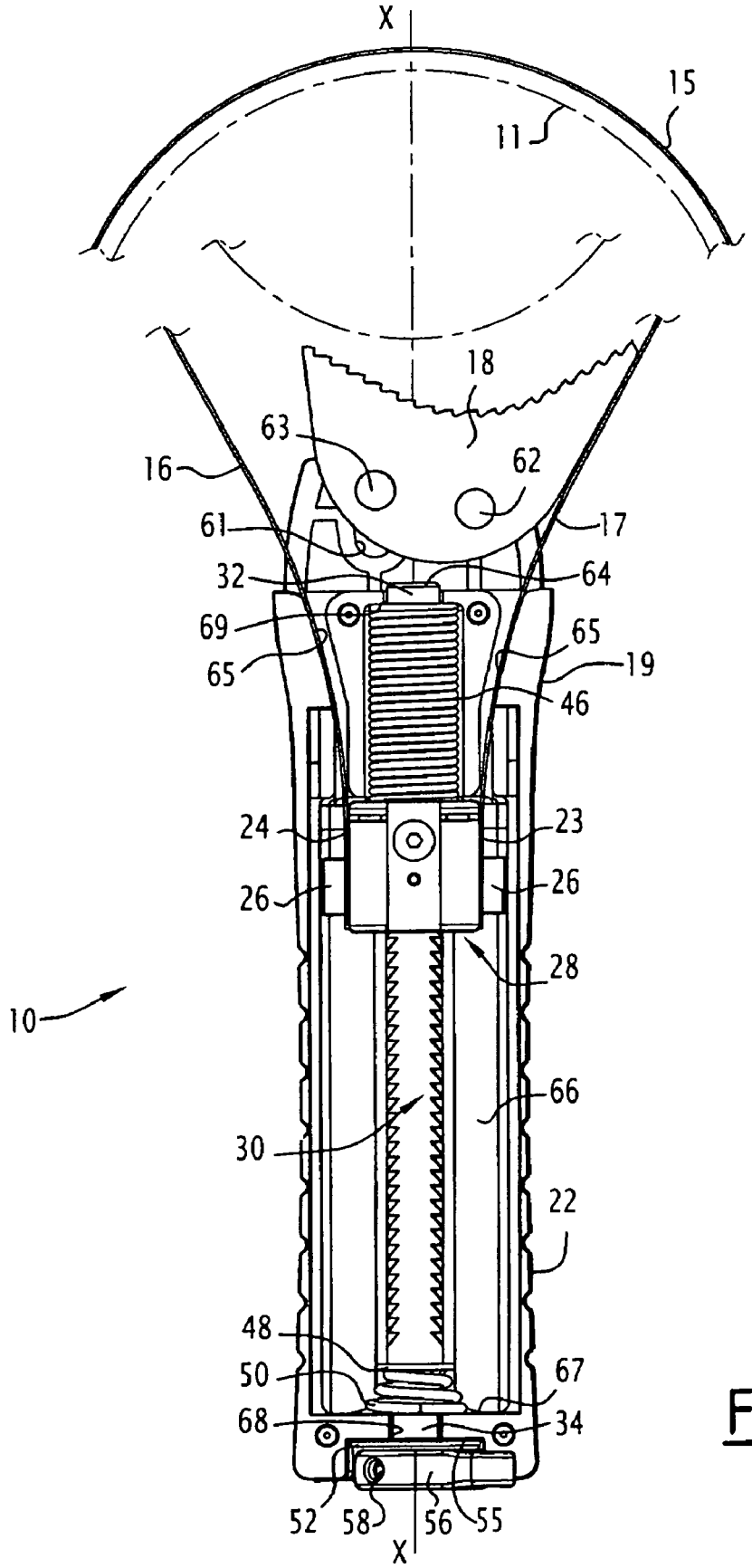
FIG. 3 is a front view of the wrench of FIG. 1 in which part of the handle has been removed.

As is shown in FIG. 3, the connecting member 28 being positioned in the internal receivers 66, the ends 32 and 34 of the rod 30 are mounted in the bearings 64 and 68 of the shell 22 so that activation of the lever 56 enables the rod 30 to rotate about the longitudinal axis X-X.

In this configuration, the helical spring 46 is compressed virtually until its turns are contiguous. The upper end of the spring 46 is in abutment on a shoulder 69 formed inside the seat 19, the shoulder being formed close to the bearing 64. The lower end of the conical spring 50 is in abutment on the wall 67 of the proximal end of the half-shell 22.

In this configuration, the connecting member 28 is locked in the top position, as will be seen hereinbelow.

Figure 4:
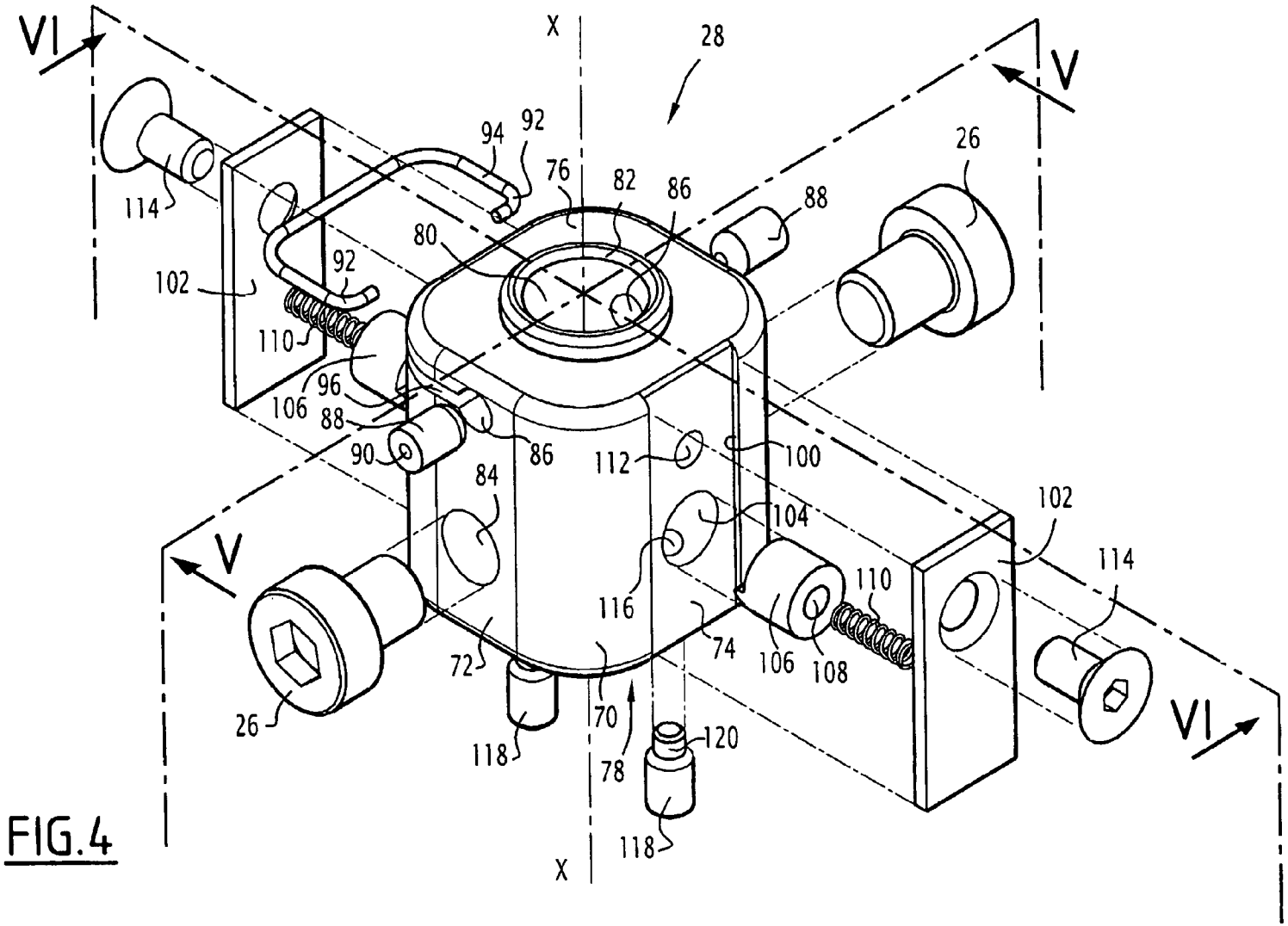
FIG. 4 is an exploded perspective view of the connecting member movable relative to the handle of the strap pipe wrench.

FIG. 4 shows the connecting member 28 in detail, the other parts of the strap pipe wrench 10 having been hidden. The connecting member 28 comprises a rigid body 70 of generally cubic shape. The body 70 has opposing pairs of lateral faces 72 and 74, a face 72 being orthogonal to a face 74. The body 70 also has an upper face 76 and a lower face 78.

A bore 80 passes through the body 70 longitudinally according to the direction of the axis X-X and opens at the upper and lower faces 76 and 78. The bore receives the rod 30 for rotation according to the longitudinal axis X-X and for translation according to that same axis.

Figure 5:
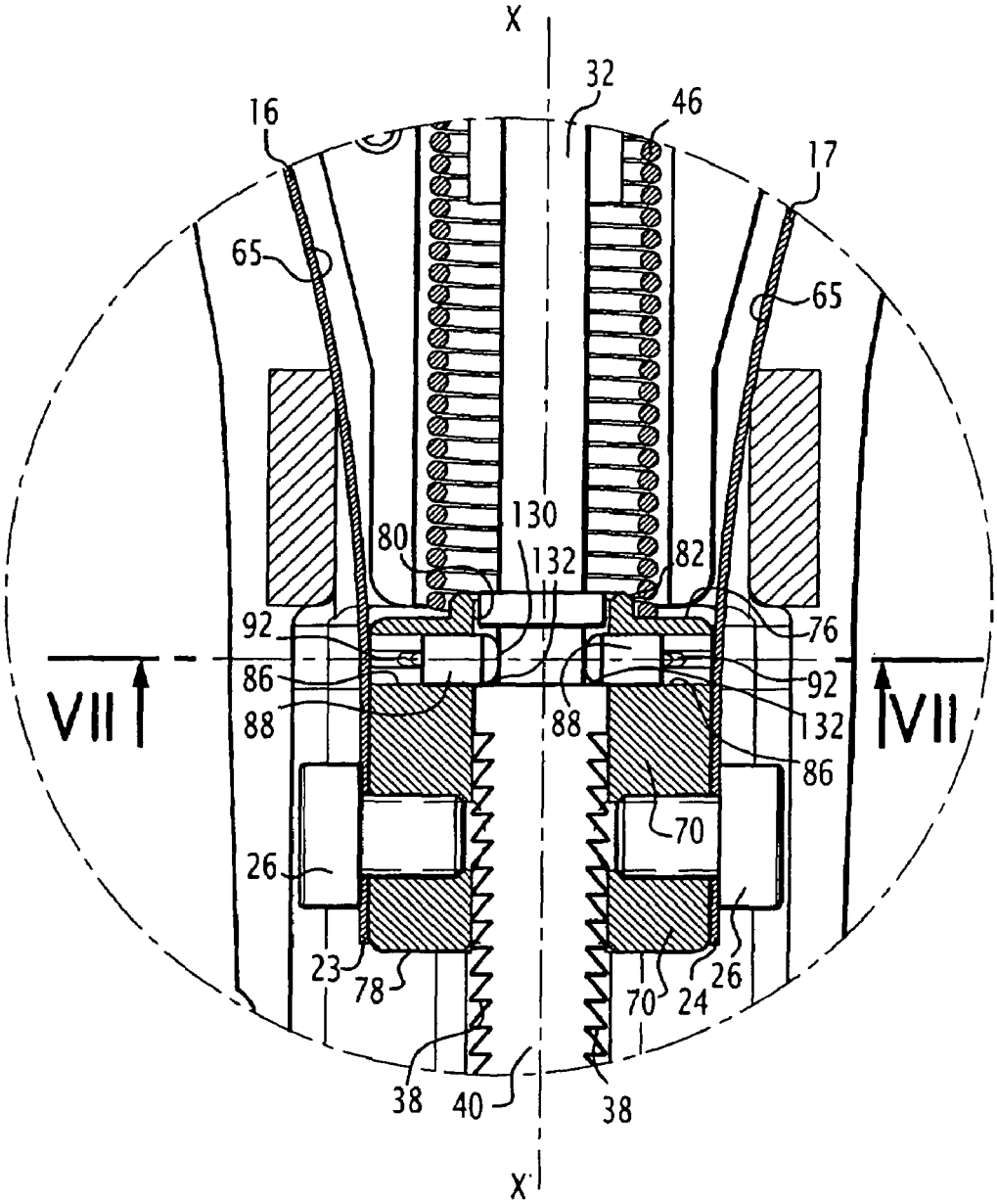
FIG. 5 is a detail view in longitudinal section according to plane V-V of FIG. 4.

A circular rib 82, which protrudes from the upper face 76, prolongs the bore 80. The outside wall of the rib 82 is of such a size as to receive, with slight clearance, the inside diameter of the turns of the helical spring 46 (FIG. 5).

The lateral faces 72 cooperate with the ends 23 and 24 of the strap 15. Threaded bores 84, which are transverse to the axis X-X and are formed in the lower portion of the faces 72, allow the fixing elements 26 to be screwed and accordingly enable the strap 15 to be attached to the connecting member 28.

Smooth bores 86, which are transverse to the axis X-X, are provided in the upper portion of the faces 72 and open into the axial bore 80.

Cylindrical pistons 88 having a shape complementary to that of the transverse bores 86 are able to slide in the transverse bores 86.

Each piston 88 has a blind central bore 90 in which there engages one of the two ends 92 of a C-shaped pin 94.

A partially circumferential groove 96 receives the main portion of the pin 94, the pin 94 acting as a spring which tends to hold the pistons 88 in the transverse bores 86.

The lateral faces 74 each have a hollow receiver 100 for receiving a fixing plate 102. Smooth bores 104, which are transverse relative to the axis X-X, formed in the lower portion of the faces 74, each receive, in a sliding manner, a cylindrical retaining finger 106 having a blind central bore 108 in which there is received one end of a helical spring 110, the other end of the helical spring 110 being in abutment against the fixing plate 102.

Threaded bores 112, transverse relative to the axis X-X, formed in the upper portion of the faces 74 permit screwing of the fixing elements 114 and, accordingly, enable the fixing plates 102 to be attached to the connecting member 28.

Threaded bores 116 arranged parallel to the longitudinal axis X-X are provided, starting from the lower face 78 of the body 70, opposite the threaded bores 104 and open into those bores. A screw 118 screwed into each of the bores 116 has a nose 120 for limiting the sliding movement of the corresponding retaining finger 106 (FIG. 6).

As is shown in FIG. 5, the connecting member 28 is suitable for assuming a first position corresponding to the position of the strap in the loose state, surrounding the filter with clearance (FIG. 1).

In that first position, the pistons 88 cooperate with a groove 130 which is formed between the upper portion 32 and the intermediate portion 36 of the rod 30 and is delimited in the lower portion by lateral faces 132 substantially perpendicular to the longitudinal axis X-X. The ends 92 of the pin 94 urge the pistons 88 to engage radially in the bottom of the groove 130. In that same position (FIG. 7), the flat areas 40 are oriented parallel to the pistons 88. The spring 46, in the compressed state, urges the connecting member 28 towards the proximal end 14 of the handle, the lateral faces of the pistons 88 being in abutment with the lower lateral faces 132 of the groove 130. The connecting member 28 is accordingly locked in the top position relative to the handle 12.

Figure 6:
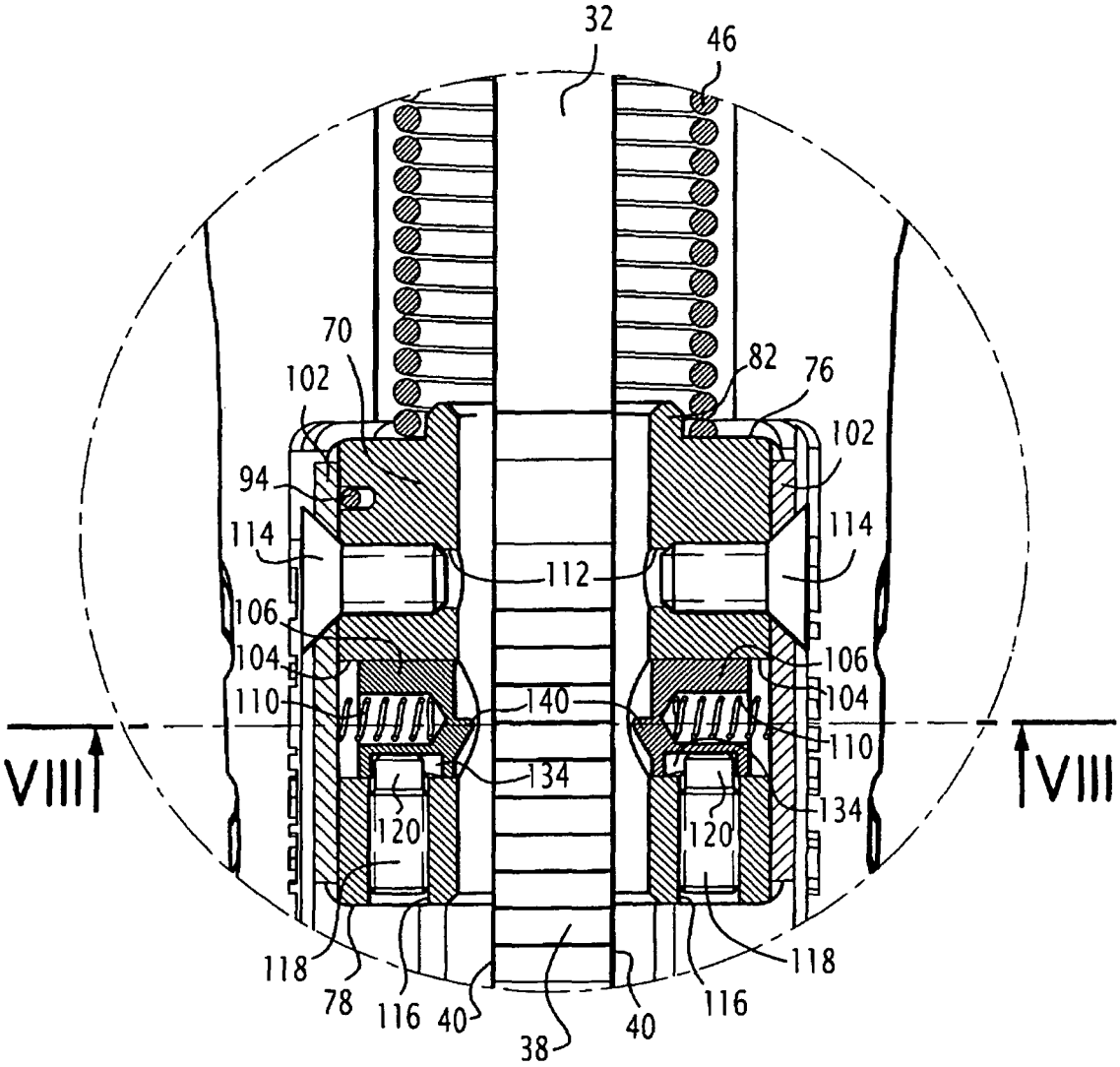
FIG. 6 is a detail view in longitudinal section according to plane VI-VI of FIG. 4.

As is shown in FIG. 6, when the connecting member 28 is in the first position, each of the retaining fingers 106 urged by the springs 110 has a lower groove 134 which is formed on its outer periphery and extends perpendicularly to the longitudinal axis X-X. Each groove 134 has a shape complementary to that of a nose 120. The nose 120 thus limits the path of the corresponding retaining finger 106 against the action of the spring 110 and, in particular, holds the corresponding finger 106 in a position in which it is in radial abutment against the rear face of the groove 134.

Each retaining finger 106 has, opposite the bore 108 in engagement with one of the ends of the spring 110, at least one tooth 140 in the form of a saw-tooth.

Figure 7:
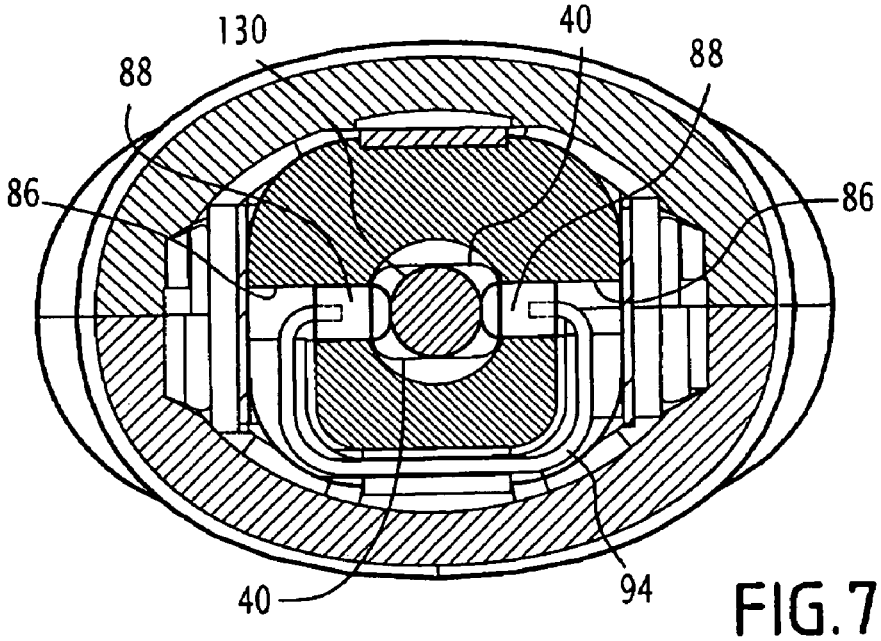
FIG. 7 is a view in transverse section according to line VII-VII of FIG. 5.

In the first position of the connecting member 28 shown in FIG. 7, the pistons 88 are in abutment at the bottom of the groove 130 against a surface having a substantially cylindrical cross-section, the diameter of which is substantially equal to the distance between the flat areas 40 of the rod 30.

Figure 8:
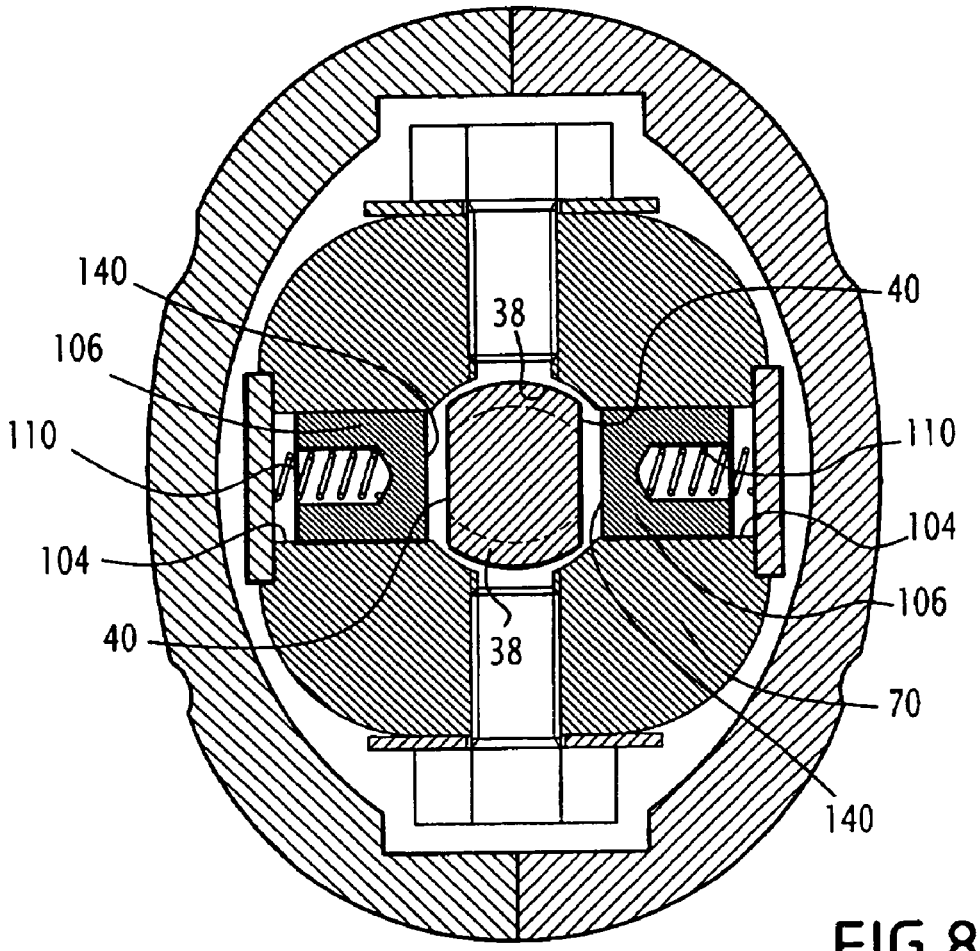
FIG. 8 is a view in transverse section according to line VIII-VIII of FIG. 6, showing a first position of the central rod.

In that same position of the connecting member 28 shown in FIG. 8, each tooth 140, cut straight, of the retaining fingers 106 is arranged opposite and at a distance from the flat areas 40 of the rod 30. The teeth of the racks 38 are in turn cut to be rounded and are arranged substantially at 90° from each tooth 140 of the retaining fingers 106.

Accordingly, in the first position of the connecting member 28, only the pistons 88 form elements for locking the connecting member 28 on the rod 30, the retaining fingers 106 not being in engagement with the racks 38 of the rod 30. The connecting member 28 is not able to slide according to the direction of the longitudinal axis X-X.

That first position of the connecting member 28 is readily obtained by previously positioning the activation lever 56 as shown in FIGS. 1 and 3, that is to say in such a manner that the pistons 88 are opposite the flat areas 40 of the rod 30. The user then grasps the handle 12 with one hand and the strap 15 with the other hand and acts manually on the strap 15 by pulling it outwards in order to increase the length of the loop extracted from the handle 12. The user of the strap pipe wrench 10 continues this action until the pistons 88 come into engagement with the groove 130. Of course, the number of grooves can be adapted to a given number of strap lengths extracted from the handle of the strap pipe wrench.

Figure 9:
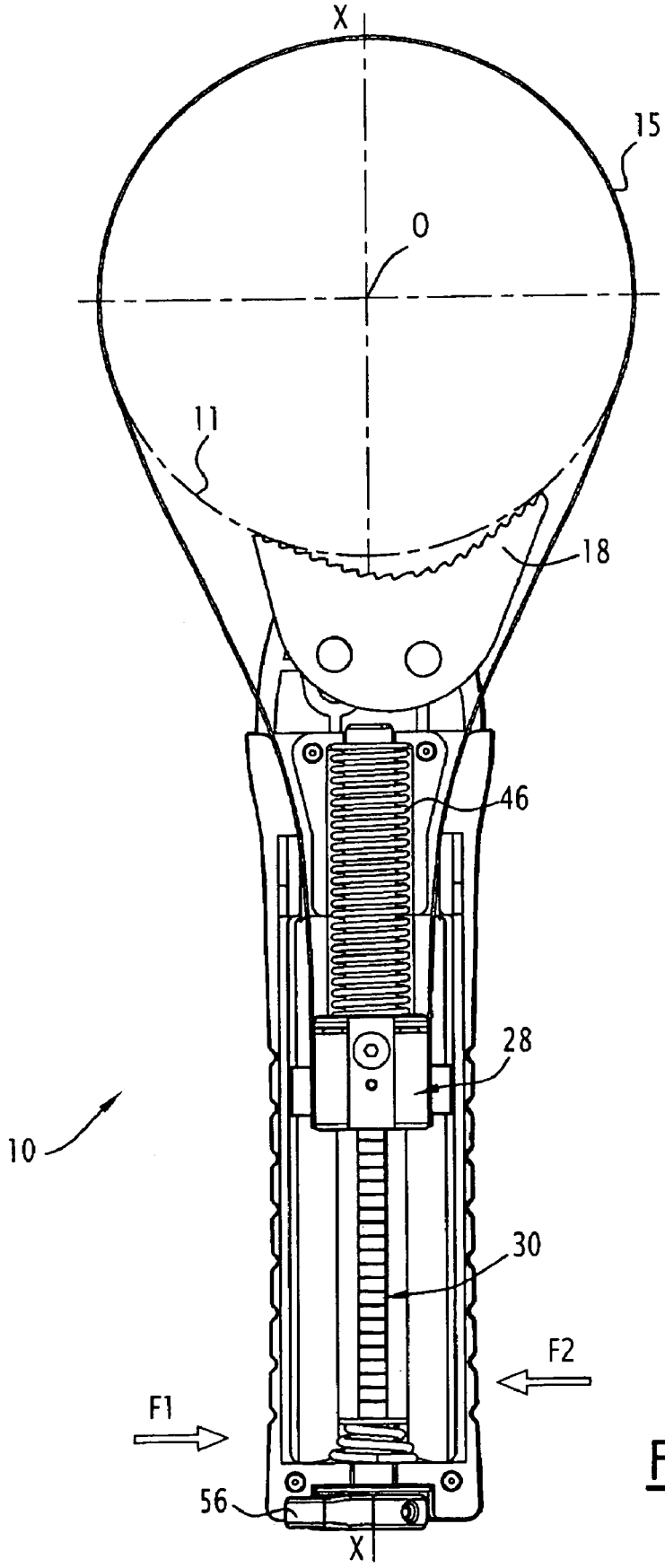
FIG. 9 is a view analogous to FIG. 3 after tight adjustment of the strap around the oil filter, the central rod being in a second position.

The connecting member 28 is movable between this first position and a second position corresponding to the position of the strap in the tensioned state surrounding, tightly and firmly, the filter in abutment on the abutment face of the shoe, as is shown in FIG. 9. In order to pass from the first position of the connecting member 28 shown in FIG. 3 to the second position of the same connecting member shown in FIG. 9, the user turns the rod 30 through an angle of 90° relative to the longitudinal axis X-X by means of the activation lever 56.

That 90° rotary movement has the effect of deactivating the locked state between the pistons 88 and the groove 130. The pistons 88 are, in fact, then positioned opposite the flat areas 40 of the rod 30. Under the release action of the compression spring 46, the connecting member 28 slides freely in the direction of the longitudinal axis X-X towards the proximal end 14 of the handle 12, the pistons coming into abutment against the flat areas 40 of the rod 30.

In that second position of the connecting member 28, the spring 46 is partially relaxed. The spring 50 acts as a shock absorber during passage from the first position to the second position of the connecting member 28.

Figure 10:
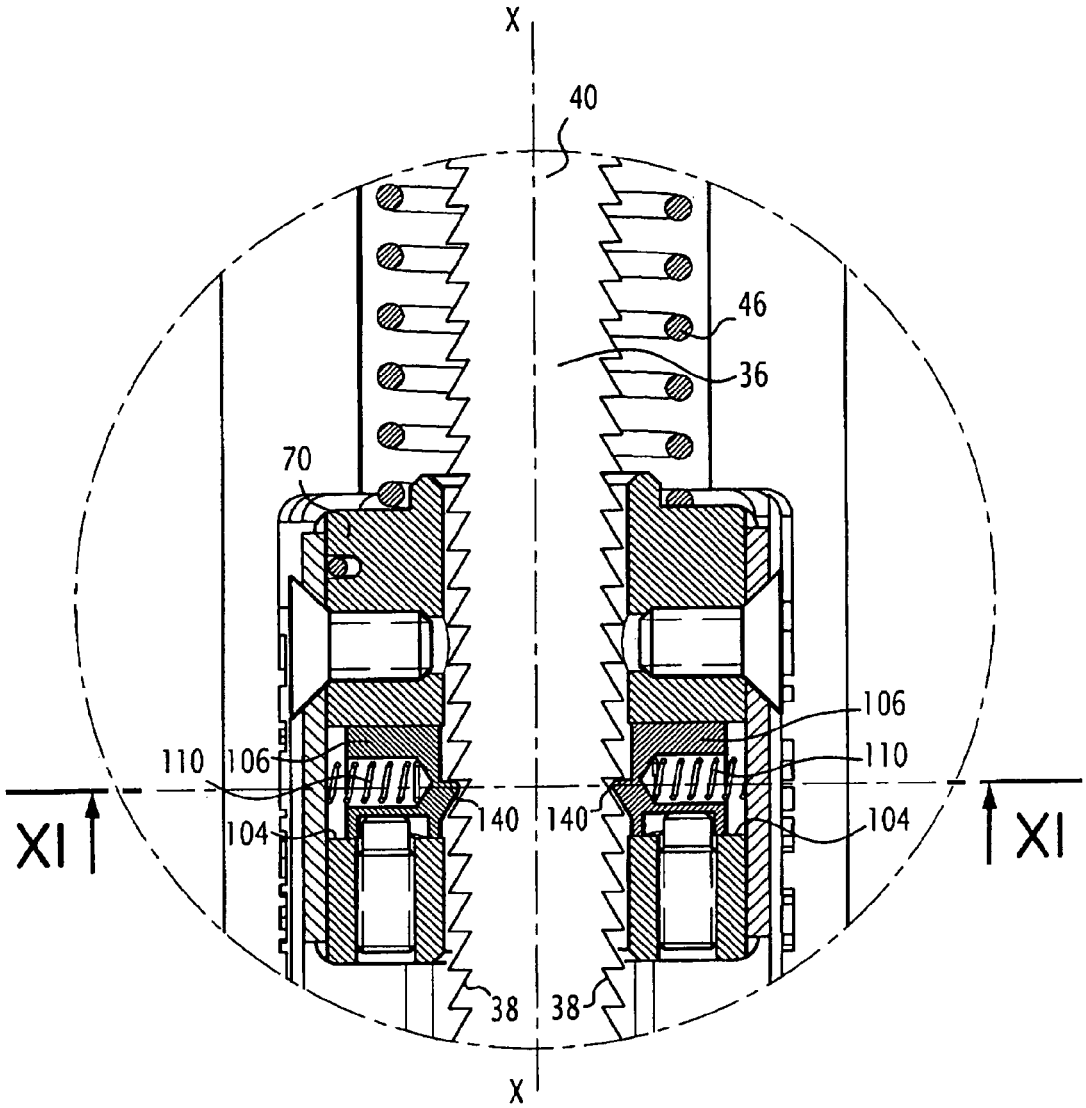
FIG. 10 is a view analogous to FIG. 6 showing the central rod in the second position.

This rotary movement of the rod 30 has also had the effect of bringing the teeth of the rack 38 into engagement with each tooth 140 of the retaining fingers 106, as is shown in FIG. 10.

During the sliding movement of the connecting member 28, which tends to move towards the proximal end 14 of the handle 12 under the effect of the relaxation of the spring 46, each tooth 140 of the retaining fingers 106 follows the saw-tooth form of the racks 38, which leads to an alternative sliding movement of the retaining fingers 106 transversely to the longitudinal axis X-X, against the springs 110 and with snapping on passing each rack tooth.

When the strap 15 and the shoe 18 are both fitted on the filter 11, with clamping, and the filter 11 is locked firmly between the strap and the shoe, each tooth 140 of the holding fingers 106 is positioned, with locking, on a tooth of the racks 38 under the action of the spring 46, which maintains the second position of the connecting member 28, with a clamping force on the filter that is determined by the strength of the spring 46.

Figure 11:
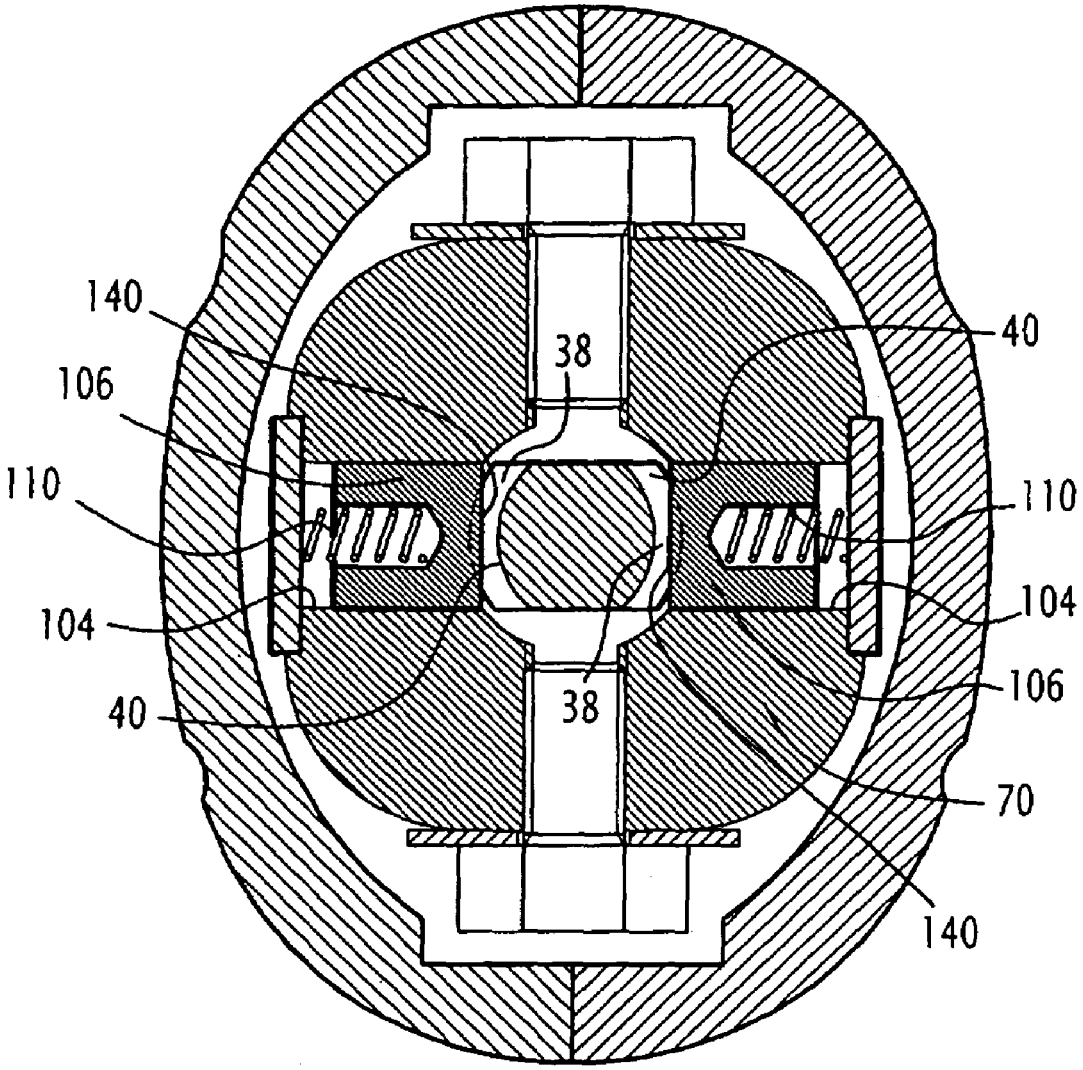
FIG. 11 is a view analogous to FIG. 8, the transverse section being taken according to line XI-XI of FIG. 10.

As is shown in FIG. 11, in that second position of the connecting member, the straight teeth 140 of the retaining fingers 136 are partially in engagement with the curved teeth of the racks 38 under the action of the springs 110.

Accordingly, the second position of the connecting member 28 is easily obtained starting from the first position of the connecting member 28 by simple rotation of the activation lever 56, in particular a 90° rotation, from the position of the activation lever 56 as shown in FIGS. 1 and 3 to the position of the activation lever 56 as shown in FIG. 9.

From that second position of the connecting member 28, the user pushes the handle 12 to the right (arrow F1 in FIG. 9). The saw-teeth of the abutment face 18A of the shoe, the coefficient of friction of which is markedly higher in one direction of rotation of the wrench than in the other direction, firmly engage with the filter, and that action drives the wrench and the filter, as a single unit, in rotation about the axis O (FIG. 9).

After a certain angle of anticlockwise rotation of the filter, for example limited by adjacent engine components, the user pushes the handle 12 to the left, that is to say in the opposite direction to that described hereinbefore (arrow F2 in FIG. 9).

Given the orientation of the saw-teeth of the shoe, sliding of the tool as a whole about the filter 11, clockwise, is obtained.

The wrench 10 accordingly has a ratchet effect, which allows a to-and-fro movement of the handle to be carried out several times in order to unscrew the filter 11 by a plurality of successive angles. The unidirectional driving of the wrench 10 is the result of a toggle lever effect, the point of articulation of the toggle lever being the geometric axis 62.

Figure 12:
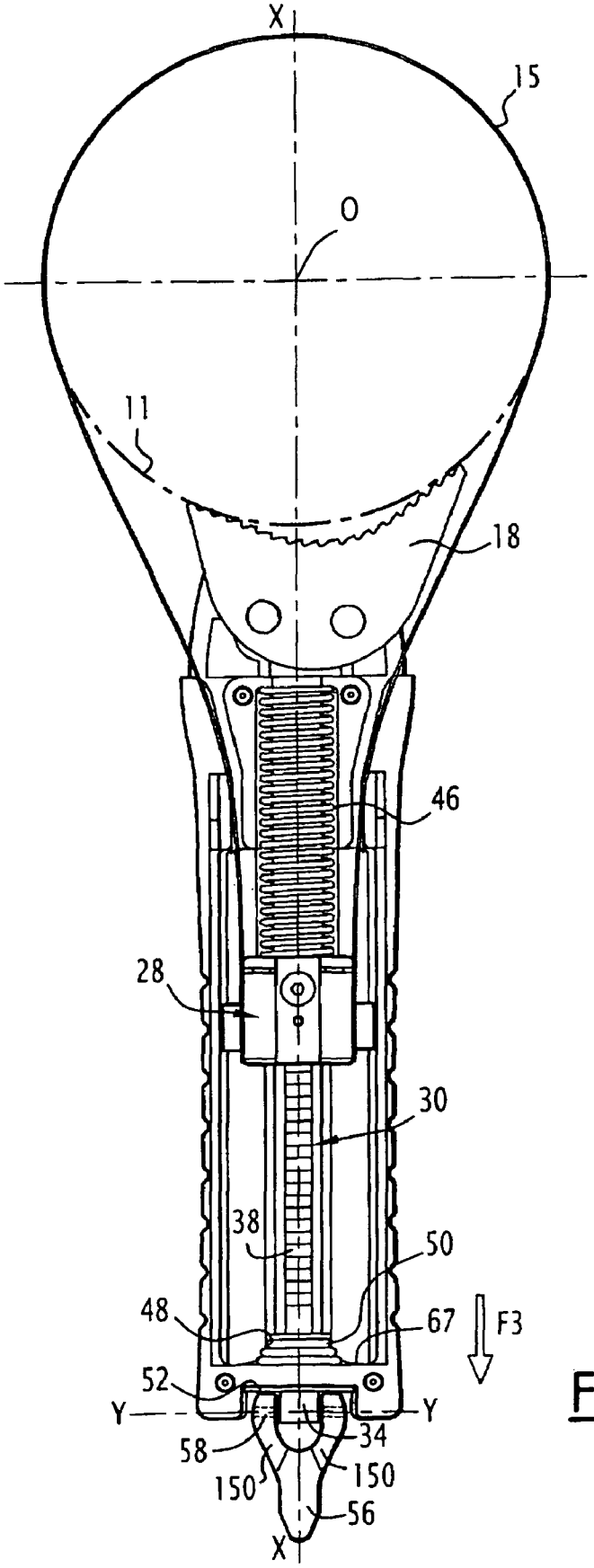
FIG. 12 is a view analogous to FIGS. 3 and 9, in which the central rod is in a third position.

In FIG. 12 it will be seen that the lever 56 has a cap between the sides 150 of which there is received the lower end 34 of the rod 30. The pin 58 connects the sides 150 to the lower end 34 of the rod 30.

This arrangement allows the activation lever 56 to rotate about the pin 58, the axis Y-Y of which is substantially perpendicular to the longitudinal axis X-X.

During the rotary movement which tends to rotate the activation lever 56 about the axis Y-Y, the ends of the sides 150 are supported on the washer 52 arranged in the receivers 54 and 55 of the half-shells 20 and 21. By means of a cam effect of the lever 56, the rod 30 is pulled in translation towards the proximal end 14 of the handle 12, according to the direction of arrow F3 in FIG. 12, against the action of the spring 50 in abutment against the washer 48 and the wall 67.

Because the connecting member 28 has remained in engagement with the rod 30, the translational movement tends to displace the connecting member 28 integrally towards the proximal end 14 of the handle 12 in order to increase the tension of the strap 15 surrounding, tightly and firmly, the filter 11 in abutment on the upper face 18A of the shoe 18.

The increase in the tension of the strap 15, which is the result of the preceding operation, tends to cancel out the ratchet effect that the abutment shoe 18 is capable of producing for unidirectional driving of the filter 11, as described in patent applications FR-A 2 779 372 and FR-A-2 779 373 cited in the preamble and which are to be taken into account in their totality in the present patent application.

Once the maintenance operation has been carried out on the oil filter, the user removes the strap pipe wrench 10 from the filter 11. To that end, he returns the activation lever 56 to its initial position corresponding to that of FIGS. 1 and 3 and pulls on the strap 15 in order to loosen it and bring the connecting member 28 into its top locking position. The worn filter which has been removed is then freed from the grasp of the strap 15. The strap pipe wrench is again ready for a fresh maintenance operation.

By virtue of the invention, adjustment of the working length of the strap and tensioning of the strap, the strap tightly surrounding the oil filter, are facilitated, which makes the tool particularly ergonomic.

The invention claimed is:

1. A strap pipe wrench for driving an object having a generally cylindrical shape, said strap pipe wrench comprising:

a handle which extends along a longitudinal axis;

a connecting member which is movable relative to said handle in a direction parallel to the longitudinal axis;

a rod passing through said connecting member;

a strap formed in a loop and having two opposing end portions which cooperate with two zones integral with said handle when said strap surrounds the object tightly, said two opposing end portions of said strap being attached to said connecting member;

a displacement device for displacing said connecting member, and enabling the size of said loop of said strap to be adjusted and said strap to be tensioned when said strap surrounds the object tightly; and a shoe disposed between said two zones for abutment on the object, said shoe having an abutment face of generally arcuate shape, wherein said shoe is not connected to said strap, wherein said connecting member is movable between at least one first position corresponding to the position of said strap in a loose state, surrounding the object with clearance, and a second position corresponding to the position of said strap in a tensioned state, surrounding the object tightly and firmly, wherein said shoe is configured such that said abutment face is in abutment with the object when said strap is in the second position, wherein said displacement device comprises:

(i) locking elements for locking said connecting member, said locking elements being configured to keep said connecting member fixed relative to said handle when said connecting member is in the first position;

(ii) a first resilient biasing element which urges said connecting member towards said second position, the first resilient biasing element being arranged coaxially with an upper portion of said rod and being in abutment on said connecting member and on said handle; and (iii) a control member configured to deactivate said locking elements, wherein said first resilient biasing element biases said connecting member to move with respect to said handle.

2. The strap pipe wrench according to claim 1, wherein said control member comprises said rod, and said rod is integral with said handle and extends inside said handle in a direction parallel to the longitudinal axis of said handle, said rod being configured to engage said locking elements at least when said connecting member is in the first position.

3. The strap pipe wrench according to claim 2, wherein said locking elements comprise at least one piston carried by said connecting member, said at least one piston being in abutment in a groove formed on said rod when said connecting member is in the first position.

4. The strap pipe wrench according to claim 3, wherein said at least one piston is urged resiliently in a direction to engage in said groove of said rod.

5. The strap pipe wrench according to claim 2, wherein said rod comprises at least one rack in which there engages at least one retaining finger carried by said connecting member when said connecting member is in the second position.

6. The strap pipe wrench according to claim 5, wherein said rod comprises four faces having two racks in the form of saw-teeth and two flat areas, said racks and said flat areas being arranged opposite one another in pairs, and wherein said connecting member comprises two retaining fingers which engage said two racks, respectively.

7. The strap pipe wrench according to claim 2, wherein said rod is mounted for rotation relative to said connecting member and to said handle about an axis of rotation that is substantially coincident with the longitudinal axis of said handle between a locking position and a release position, wherein said locking position corresponds to the first position of said connecting member, in which said at least one piston enters said groove, and wherein the release position is arranged 90° from the locking position of said rod and corresponds to the second position of said connecting member, in which said at least one piston is in abutment on a flat area of said rod.

8. The strap pipe wrench according to claim 7, wherein said control member further comprises an activation lever which enables said rod to be rotated from the locking position to the release position and from the release position to the locking position.

9. The strap pipe wrench according to claim 8, wherein said rod is movable towards the proximal end of said handle, against a second resilient biasing element, so as to displace said connecting member in order to increase the tension of said strap surrounding, tightly and firmly, the object in abutment on said abutment face of said shoe, and wherein said activation lever allows said rod to pass from the second position to a third position corresponding to the displacement of said rod.

10. The strap pipe wrench according to claim 2, wherein said rod is movable towards the proximal end of said handle, against a second resilient biasing element, so as to displace said connecting member in order to increase the tension of said strap surrounding, tightly and firmly, the object in abutment on said abutment face of said shoe.

11. The strap pipe wrench according to claim 1, wherein said abutment shoe is adapted to produce a ratchet effect for unidirectional driving of the object, the unidirectional driving resulting from a toggle lever effect.

12. The strap pipe wrench according to claim 1, wherein said abutment shoe is mounted to tilt relative to said handle about a geometric axis associated with said handle and perpendicular to the general plane of said strap, the geometric axis being arranged so that, said shoe and said strap both being applied, with clamping, to the object, action on said handle exerted in a first direction causes driving of the object and action on said handle exerted in the other direction causes said shoe and said strap to slide on the object.

13. The strap pipe wrench according to claim 12, wherein the geometric axis is offset laterally relative to the longitudinal axis of said handle, the direction of the offset being the first direction.

14. The strap pipe wrench according to claim 12, wherein said abutment shoe is mounted to tilt freely and with a limited amplitude about the geometric axis.

15. The strap pipe wrench according to claim 12, wherein said abutment shoe has an abutment face with a coefficient of friction that is higher in one direction of rotation of said wrench than in the other direction.

16. The strap pipe wrench according to claim 1, wherein said abutment face of said shoe includes ridges.

17. A strap pipe wrench for driving an object having a generally cylindrical shape, said strap pipe wrench comprising:

a handle which extends along a longitudinal axis;

a connecting member which is movable relative to said handle in a direction parallel to the longitudinal axis;

a rod passing through said connecting member;

a strap formed in a loop and having two opposing end portions which cooperate with two zones integral with said handle when said strap surrounds the object tightly, said two opposing end portions of said strap being attached to said connecting member;

a displacement device for displacing said connecting member, and enabling the size of said loop of said strap to be adjusted and said strap to be tensioned when said strap surrounds the object tightly; and a shoe disposed between said two zones for abutment on the object, said shoe having an abutment face of generally arcuate shape, wherein said shoe is not connected to said strap, wherein said connecting member is movable between at least one first position corresponding to the position of said strap in a loose state, surrounding the object with clearance, and a second position corresponding to the position of said strap in a tensioned state, surrounding the object tightly and firmly, wherein said shoe is configured such that said abutment face is in abutment with the object when said strap is in the second position, wherein said displacement device comprises:

(i) locking elements for locking said connecting member, said locking elements being configured to keep said connecting member fixed relative to said handle when said connecting member is in the first position;

(ii) a first resilient biasing element, which urges said connecting member towards said second position, the first resilient biasing element being arranged coaxially with an upper portion of said rod and being in abutment on said connecting member and on said handle; and (iii) a control member configured to deactivate said locking elements.

18. A strap pipe wrench for driving an object having a generally cylindrical shape, said strap pipe wrench comprising:

a handle which extends along a longitudinal axis;

a connecting member which is movable relative to said handle in a direction parallel to the longitudinal axis;

a strap formed in a loop and having two opposing end portions which cooperate with two zones integral with said handle when said strap surrounds the object tightly, said two opposing end portions of said strap being attached to said connecting member;

a displacement device for displacing said connecting member, and enabling the size of said loop of said strap to be adjusted and said strap to be tensioned when said strap surrounds the object tightly; and a shoe disposed between said two zones, said shoe having an abutment face for abutment on the object, wherein said connecting member is movable between at least one first position corresponding to the position of said strap in a loose state, surrounding the object with clearance, and a second position corresponding to the position of said strap in a tensioned state, surrounding the object tightly and firmly, wherein said shoe is configured such that said abutment face is in abutment with the object when said strap is in the second position, wherein said displacement device comprises:

(i) locking elements for locking said connecting member, said locking elements being configured to keep said connecting member fixed relative to said handle when said connecting member is in the first position;

(ii) a first resilient biasing element which urges said connecting member towards said second position; and (iii) a control member configured to deactivate said locking elements, wherein said control member comprises a rod which is integral with said handle and extends inside said handle in a direction parallel to the longitudinal axis of said handle, said rod being configured to engage said locking elements at least when said connecting member is in the first position, and wherein said locking elements comprise at least one piston carried by said connecting member, said at least one piston being in abutment in a groove formed on said rod when said connecting member is in the first position.

* * * * *